US007048275B2

(12) United States Patent
Adams

(10) Patent No.: US 7,048,275 B2
(45) **Date of Patent: *May 23, 2006**

(54) SYSTEM TO PROVIDE A PLAYER WITH THE ABILITY TO RESERVE A WILD INDICIA FOR USE IN ONE OR MORE SUBSEQUENT GAMES

(75) Inventor: William R. Adams, Las Vegas, NV (US)

(73) Assignee: IGT, Reno, NV (US)

( * ) Notice: Subject to any disclaimer, the term of this patent is extended or adjusted under 35 U.S.C. 154(b) by 48 days.

This patent is subject to a terminal disclaimer.

(21) Appl. No.: 10/655,724

(22) Filed: Sep. 5, 2003

(65) Prior Publication Data

US 2004/0084844 A1 May 6, 2004

Related U.S. Application Data

(63) Continuation of application No. 10/281,787, filed on Oct. 28, 2002, now Pat. No. 6,616,142, which is a continuation of application No. 09/994,245, filed on Nov. 26, 2001, now Pat. No. 6,494,454, which is a continuation of application No. 09/664,257, filed on Sep. 18, 2000, now Pat. No. 6,322,078, which is a continuation of application No. 08/838,178, filed on Apr. 16, 1997, now Pat. No. 6,120,031, which is a continuation of application No. 08/500,532, filed on Jul. 11, 1995, now abandoned, which is a continuation-in-part of application No. 08/311,781, filed on Sep. 23, 1994, now Pat. No. 5,431,408.

(51) Int. Cl.
*A63F 1/00* (2006.01)

(52) U.S. Cl. ..... 273/292; 273/303; 273/304; 273/305; 273/306; 273/138 A; 463/12; 463/13

(58) Field of Classification Search ..... 273/292, 273/303–306; 463/12–13
See application file for complete search history.

(56) References Cited

U.S. PATENT DOCUMENTS

| | | | |
|---|---|---|---|
| 1,738,902 | A | 12/1929 | Howard |
| 2,639,922 | A | 5/1953 | Laycott |
| 2,687,306 | A | 8/1954 | Cheng |
| 4,591,162 | A | 5/1986 | Fakhoury |

(Continued)

FOREIGN PATENT DOCUMENTS

AU 766975 10/2003

(Continued)

OTHER PUBLICATIONS

"Jackpots," *Hoyle's Modern Encyclopedia of Card Games,* Walter Gibson, 1974, p. 253.

(Continued)

*Primary Examiner*—Eugene Kim
*Assistant Examiner*—Dolores R. Collins
(74) *Attorney, Agent, or Firm*—Marshall, Gerstein & Borun LLP

(57) ABSTRACT

A gaming device is provided that includes a display screen that is capable of generating video images, the gaming device being programmed to select a first group of indicia from a plurality of indicia in a first game, wherein the plurality of indicia include a plurality of playing indicia and at least one wild indicia. The gaming device also being programmed to cause a video image representing the first game to be displayed on the display screen, to provide a player with a winning advantage if the player receives the at least one wild indicia, and to limit the use of the at least one wild indicia.

44 Claims, 4 Drawing Sheets

U.S. PATENT DOCUMENTS

| | | | | | |
|---|---|---|---|---|---|
| 4,721,307 | A | | 1/1988 | Okada | |
| 4,743,022 | A | * | 5/1988 | Wood | 463/13 |
| 4,846,480 | A | | 7/1989 | Oliver | |
| 4,915,393 | A | | 4/1990 | Oliver | |
| 5,046,736 | A | * | 9/1991 | Bridgeman et al. | 463/13 |
| 5,100,137 | A | | 3/1992 | Fulton | |
| 5,242,163 | A | | 9/1993 | Fulton | |
| 5,251,897 | A | | 10/1993 | Fulton | |
| 5,282,633 | A | | 2/1994 | Boylan et al. | |
| 5,308,065 | A | | 5/1994 | Bridgeman et al. | |
| 5,310,347 | A | | 5/1994 | Brand | |
| 5,332,219 | A | * | 7/1994 | Marnell et al. | 463/13 |
| 5,356,140 | A | * | 10/1994 | Dabrowski et al. | 463/12 |
| 5,393,057 | A | * | 2/1995 | Marnell, II | 463/13 |
| 5,411,257 | A | | 5/1995 | Fulton | |
| 5,431,408 | A | * | 7/1995 | Adams | 273/306 |
| 5,437,451 | A | | 8/1995 | Fulton | |
| 5,820,460 | A | | 10/1998 | Fulton | |
| 5,833,537 | A | | 11/1998 | Barrie | |
| 5,944,315 | A | | 8/1999 | Mostashari | |
| 5,947,821 | A | | 9/1999 | Stone | |
| 6,036,190 | A | | 3/2000 | Edmunds et al. | |
| 6,120,031 | A | * | 9/2000 | Adams | 273/292 |
| 6,248,016 | B1 | | 6/2001 | Walker et al. | |
| 6,299,170 | B1 | * | 10/2001 | Yoseloff | 273/292 |
| 6,322,078 | B1 | * | 11/2001 | Adams | 273/292 |
| 6,494,454 | B1 | * | 12/2002 | Adams | 273/292 |
| 6,616,142 | B1 | * | 9/2003 | Adams | 273/292 |

FOREIGN PATENT DOCUMENTS

| | | | |
|---|---|---|---|
| EP | 0 238 289 | A2 | 9/1987 |
| EP | 0 753 331 | A2 | 1/1997 |
| GB | 2 050 028 | A | 12/1980 |
| GB | 2 062 922 | A | 5/1981 |
| GB | 2 170 938 | A | 8/1986 |
| WO | WO 93/05855 | A1 | 4/1993 |

OTHER PUBLICATIONS

"Draw Poker with Deuces Wild," *Hoyle's Simplified Guide to the Popular Card Games,* Walter Gibson, 1963, p. 124.

* cited by examiner

SYSTEM TO PROVIDE A PLAYER WITH THE ABILITY TO RESERVE A WILD INDICIA FOR USE IN ONE OR MORE SUBSEQUENT GAMES

This application is a continuation of U.S. patent application Ser. No. 10/281,787, filed Oct. 28, 2002, which issued as U.S. Pat. No. 6,616,142 which is a continuation of application Ser. No. 09/994,245 filed on Nov. 26, 2001, which issued as U.S. Pat. No. 6,494,454 which is a continuation of U.S. patent application Ser. No. 09/664,257, filed on Sep. 18, 2000, which issued as U.S. Pat. No. 6,322,078, which is a continuation of U.S. patent application Ser. No. 08/838,178, filed on Apr. 16, 1997, which issued as U.S. Pat. No. 6,120,031, which is a continuation of U.S. patent application Ser. No. 08/500,532, filed on Jul. 11, 1995, which was abandoned, which is a continuation-in-part of U.S. patent application Ser. No. 08/311,781, filed on Sep. 23, 1994, which issued as U.S. Pat. No. 5,431,408.

The present invention is directed to games and, more particularly, to novel games which provide a player with the opportunity to reserve a "wild" indicia from one play for use in a subsequent play.

BACKGROUND OF THE INVENTION

Games utilizing playing cards are popular throughout the world. Many people get hours of enjoyment and relaxation from playing cards. In certain parts of the world, wagering adds an additional dimension of excitement to the game. Whether in "card room" games where the players play against each other or in a traditional "casino" game environment where an employee of the house acts as a banker, wagering adds excitement to many forms of card games.

Players involved in card games with wagering often enjoy new games with relatively simple rules that can readily be learned by a beginner or casual player.

Typical card games involve a dealer providing a plurality of cards to each player. Each player then gathers the cards and tries to form the best possible hand according to some predetermined hierarchy of hand values. For example, a standard poker hierarchy is, in descending order, Royal Flush, Straight Flush, Four of a Kind, Full House, Flush, Straight, Three of a Kind, Two Pair, One Pair, and High Card. In some games, players are permitted to discard certain cards and receive new cards in an effort to form a better hand.

It is also common to designate one or more cards as "wild" cards which can have any one of a predetermined number of values at the option of the player(s) receiving such wild cards. In this manner, the designation of wild cards within a deck can significantly increase the chances of a player attaining a particular hand. In known games which utilize wild cards, players must use the wild card in the hand in which the wild card is received. Therefore, if a player has a card hand of low or no value, the wild card may not be sufficient to allow that player to form a winning hand. For example, if the payout schedule for a given game starts at a pair of jacks, and the player has the following hand: 2, 4, 5, 10 of different suits and a wild card, the best poker hand that the player could form with one wild card would be a pair of 10's. This hand would not qualify for a winning payout.

It is, therefore, desirable to provide a card game which increases the player's excitement and enjoyment, as well as the level of player participation by providing a player with an opportunity to maximize the impact of receiving a wild card.

It is also desirable to provide wagering games other than cards with an exciting, new feature which comprises a wild indicia and novel methods of using that wild indicia.

It is also desirable to provide novel games readily adaptable to wagering which are relatively simple to learn for new players.

It is also desirable to provide games which provide one or more players with opportunities to modify the player's winning payout by using such a wild indicia, received during one play, with a subsequent play.

SUMMARY OF THE INVENTION

The various embodiments of the present invention are directed to games which provide a player who has received at least one wild indicia during one play with the opportunity to reserve that wild indicia for use in a subsequent play. The advantages of the present invention are applicable to a wide variety of games including "card" games and other conventional games of chance or skill including keno, bingo, gaming devices, such as reel slots, dice games and lotto. As used herein, the term "card game" is intended to include conventional table/board type games wherein one or more persons deal actual playing cards to one or more players, as well as any type of mechanical or electronic devices which display indicia of playing cards.

According to an aspect of the invention, a gaming device is provided that includes a display screen that is capable of generating video images, and the gaming device is programmed to select a first group of indicia from a plurality of indicia in a first game, wherein the plurality of indicia include a plurality of playing indicia and at least one wild indicia. The gaming device is also programmed to cause a video image representing the first game to be displayed on the display screen, to provide a player with a winning advantage if the player receives the at least one wild indicia, and to limit the use of the at least one wild indicia.

According to another aspect of the invention, a gaming device is provided that includes a display screen that is capable of generating video images, a plurality of selection devices, and a value input device. The gaming device is programmed to determine that a player has used the value input device to make a wager, provide a first group of playing indicia to define a first game, the first group of playing indicia being selected from a plurality of playing indicia, and provide at least one wild indicia for use in other than the first game. The gaming device is also programmed to cause a video image representing the first game to be displayed on the display screen, determine that the player has used one of the plurality of selection devices to reserve the at least one wild indicia for use in a subsequent game, determine a first game outcome associated with the first group of playing indicia, and determine a first payout according to a payout schedule, the first payout being associated with the first game outcome. The gaming device is further programmed to provide a subsequent group of playing indicia to define the subsequent game, the subsequent group of playing indicia being selected from the plurality of playing indicia, determine that the player has used at least one of the plurality of selection devices to combine the at least one wild indicia with the subsequent group of playing indicia to define a modified group of playing indicia, determine a game outcome associated with the modified group of playing indicia, and determine a subsequent payout associated with the game outcome associated with the modified group of playing indicia by modifying the payout for the game outcome associated with the modified group of playing indicia.

According to a third aspect of the invention, a gaming device is provided that includes a display screen that is capable of generating video images, a value input device, and a plurality of selection devices. The gaming device is programmed to select a first group of indicia from a plurality of indicia in a first game, the plurality of indicia including a plurality of playing indicia and a wild indicia, wherein the wild indicia is not one of the plurality of playing indicia, and provide a player with the option of reserving the wild indicia in the first game for use in a subsequent game.

The wild indicia of the present invention may take any form desired by the players or the establishment conducting the game. For example, when playing a card game, the wild indicia will typically comprise a wild card. While jokers maybe utilized to indicate a wild card, it is also within the scope of the present invention to use one or more other indicia such as one of the other cards of a deck or non-conventional indicia to indicate a wild card. Similarly, in games other than card games, any form of wild indicia may be utilized. In all forms of the present invention, a player is provided with the possibility of utilizing a wild indicia when it is most advantageous for the player to do so, i.e., when the player will maximize a winning payout. When a player receives a wild indicia, the player can use that wild indicia immediately or may reserve the wild indicia for use in a subsequent play. For example, a player may use a wild card in a subsequent hand or may use a wild indicia received during the play of one game of bingo in a subsequent game.

One preferred embodiment of the present invention comprises a gaming device having an electronic touch-sensitive screen which is controlled, at least in part, by a player touching images on the screen.

Another embodiment of the present invention comprises a gaming device wherein input from a player is supplied to a device through actuation buttons.

A still further embodiment of the present invention comprises a game table designed for use by a dealer and a plurality of players. Along with conventional indicia on the game table including betting areas for each player, each player area is also provided with a reserve area wherein a player may place a wild card if that player decides not to use the wild card in the hand in which he receives the wild card and prefers to use the wild card in a later hand.

Each of the embodiments of the present invention provides one or more players with opportunities to maximize the beneficial effect of a wild indicia.

These and other embodiments are described in greater detail with reference to the drawings.

DETAILED DESCRIPTION

Figure 1:
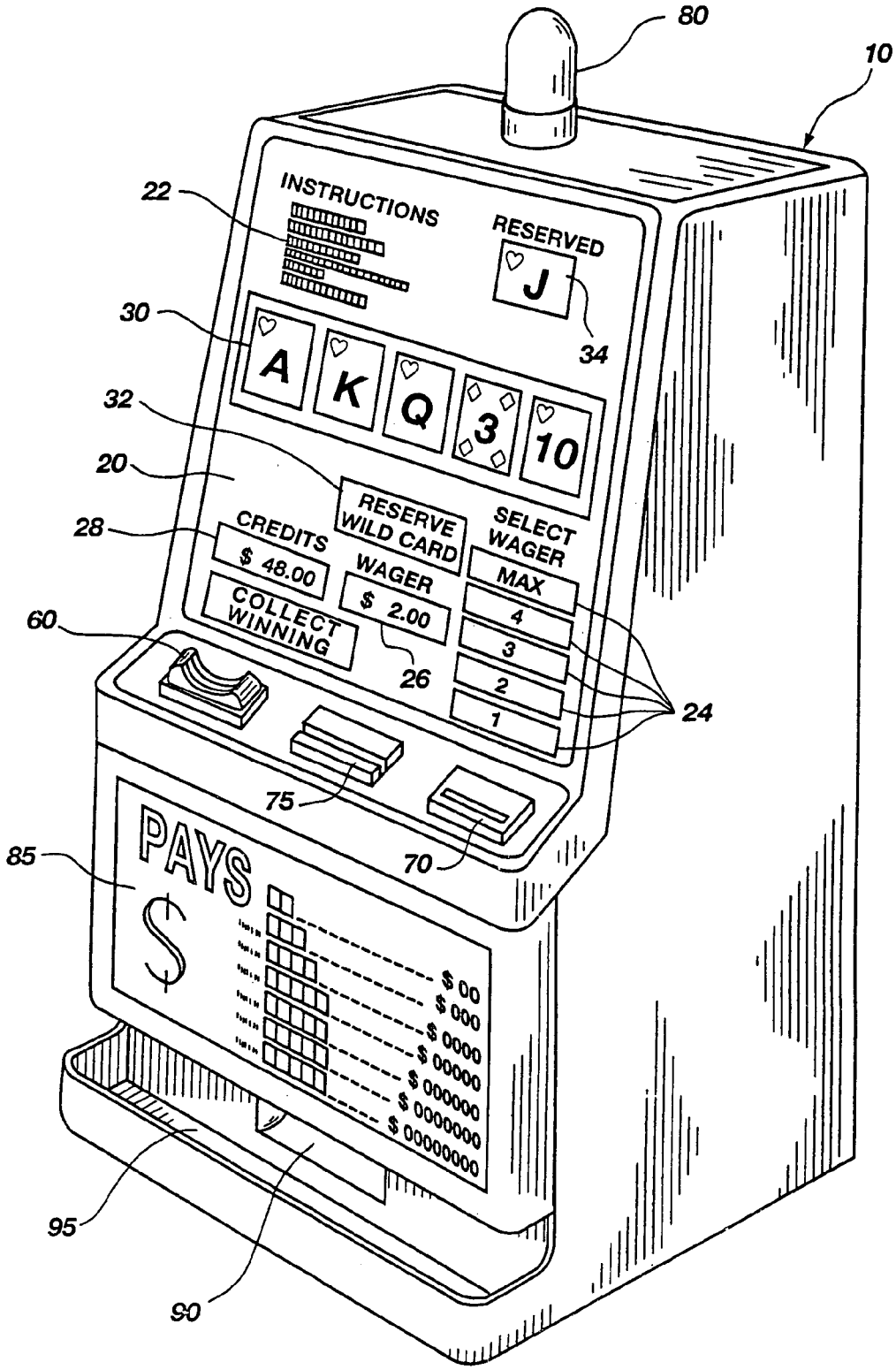
FIG. 1 illustrates a gaming device embodiment of the present invention comprising a touch screen.

The various embodiments of the present invention increase the level of player input, increase the likelihood of a winning payout, provide at least one player with the possibility to maximize the amount of a winning payout, and increase the overall level of enjoyment to a game which utilizes at least one wild indicia. The present invention achieves these desirable results by providing a player who receives a wild indicia during the play of one game with the option of reserving that wild indicia for use in a subsequent game.

While the various embodiments of the present invention are illustrated in conjunction with a game of five-card draw poker, the advantages of the present invention are equally applicable to a wide variety of other games of skill or chance.

According to the illustrated embodiments, five indicia of playing cards are displayed to a player. The player is provided with the opportunity to discard one or more of the cards and, if the player has received a wild card, to place that wild card in a reserve area for use with a later hand. To the extent that the player has discarded any cards or moved a wild card from his hand to a reserve area, the player is provided with replacement cards. Furthermore, a player may be provided with the option of reserving a wild card even if that player received the wild card as a draw card, i,e., as a replacement to one of the first indicia of playing cards displayed to that player. A winning payout is then provided to either the player with the highest hand or to any players which have attained a winning hand as determined by a predetermined payout schedule.

According to one preferred embodiment of the present invention, a first plurality of playing card indicia which is displayed to a player is selected from a collection which does not include a wild card. In this manner, the game can be controlled so that the first plurality of card indicia displayed to a player never contains a wild card. The cards remaining after making the first display can then be reshuffled along with one or more wild cards to form a second collection of cards from which additional cards are selected. The first plurality of playing card indicia may comprise a number of cards sufficient to form a complete hand or some lower number of cards. For example, the first three cards displayed to a player in a five-card poker hand may be selected from the first collection, which does not include any wild cards, while all remaining cards may be selected from collections to which at least one wild card indicia has been added. Similarly, wild card indicia may be placed in a first collection of cards from which the player's first card indicia are selected and then wild card indicia not displayed to one or more players as of a certain point in a hand may be removed so that no further wild cards are displayed. For example, in a five-card draw poker game, each player's first five cards may be selected from a first collection comprising one or more wild cards while draw cards may be selected from a second collection from which wild cards have been removed.

From the present description, those skilled in the art will appreciate that the odds of a player attaining a successful hand may be modified by modifying certain parameters of a game including the number of wild cards used, the number of indicia displayed from collections comprising one or more wild indicia, and the timing of when indicia are selected from collections comprising wild indicia. These and other parameters may be modified without departing from the scope of the present invention.

Further limitations can be placed upon one or more of the games of the present invention by limiting the number of plays for which a player may reserve a wild indicia. For example, in a game of bingo, a player may be provided with the opportunity of reserving a wild indicia for ten bingo games. In such instances, if the player does not use the reserved wild indicia within ten games after the wild indicia was displayed, the wild indicia would be forfeited. Similarly, in a card game, a player may be limited to utilizing a wild indicia in a certain number of hands following receipt of that wild indicia. By so limiting the use of a wild indicia, a player's chances of achieving a very high payout can be controlled. Those skilled in the art will also appreciate that the chances of displaying a wild indicia to a player can be controlled by controlling the total number of playing indicia in the collection from which cards are selected, by controlling the number of wild indicia added to the collection, as well as by keeping the wild indicia out of the collection until a predetermined number of indicia have been displayed.

FIG. 1 illustrates one embodiment of the present invention in the form of a gaming device 10 having a pressure-sensitive touch screen 20, a coin slot 60, a bill validator 70, a credit card receiver/terminal 75, flashing light 80, payout schedule 85, coin chute 90 and coin trough 95. This embodiment of the present invention can be activated by a player inserting an item of monetary value including coins, paper currency, tokens, or some form of credit indicator, such as a credit card. Suitable instructions are provided in instruction window 22 to guide a player through the initial steps necessary to start the game, as well as through subsequent steps. If a player has inserted more than the amount of the minimum wager, the player will be required to designate the amount of his wager by touching the corresponding wager area 24 under the designation "SELECT WAGER." The amount wagered will then be displayed in wager window 26. If the player has inserted an amount greater than the amount wagered, the player's remaining credits will appear in the credits window 28. Wagers for subsequent hands can then be automatically drawn from the player's credits in a manner which is now well known in the art.

After a player has selected an amount for an initial wager, a plurality of indicia of playing cards 30 is displayed on the screen. Following instructions and prompts provided in instruction window 22, the player may opt to hold one or more of the cards by simply touching the image of the card on screen 20. An actuator may also be provided for this and other player input on a button panel. If the player receives a wild card, the player may also opt to reserve the wild card for use in a subsequent hand by touching the "RESERVE WILD CARD" area 32. When a player reserves a wild card, the player is preferably provided with an image of the wild card in reserved area 34. In this and other embodiments of the present invention, a player may or may not be permitted to utilize a wild indicia in the same hand or game in which the player designated that the wild indicia be reserved. Such rules are preferably set by the house or other rulemaker prior to play. Furthermore, as stated above, a player may receive a wild indicia either in an initial display or in a subsequent display, such as cards drawn after a discard.

If the player has discarded any cards and/or reserved a wild card, replacement cards are provided to the player's hand and displayed in card display area 30. If the resulting display comprises one of a predetermined plurality of winning card hands, the player is provided with a winning payout. Particularly high winning payouts may be accompanied by discernable signals such as a flashing light 80 and audible sirens from a speaker (not shown). The amount that the player has won is then preferably added to the amount shown in the "CREDITS" window 28.

Figure 2:
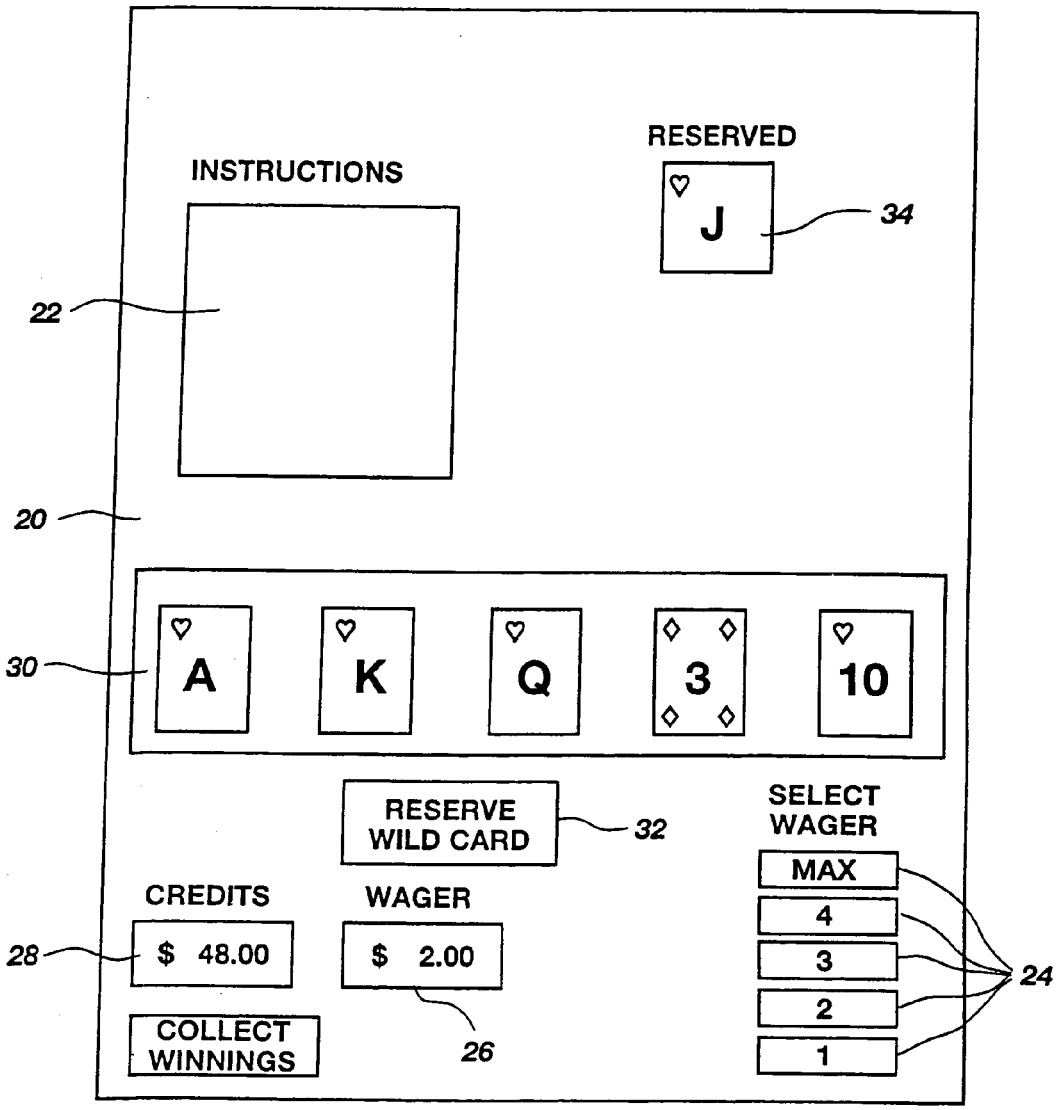
FIG. 2 illustrates a touch screen used with the embodiment of FIG. 1.

As an example, the hand shown in card display area 30 of FIG. 2 indicates a hand in which a player would want to utilize a wild card previously held in RESERVED area 34. Those familiar with poker will appreciate that by replacing the 3 of diamonds with the wild card, the player will have attained a Royal Flush and, typically, a large payout.

Since the present invention can be played with a wide variety of games, the winning payouts for a winning hand can vary widely. As an example, with the five-card draw poker game described above, the payout schedule could be as follows:

SAMPLE TABLE PAYOUT SCHEDULE

| | |
|---|---|
| Royal Flush | 800 for 1 |
| Straight Flush | 50 for 1 |
| Four Of A Kind | 25 for 1 |
| Full House | 8 for 1 |
| Flush | 5 for 1 |
| Straight | 4 for 1 |
| Three Of A Kind | 3 for 1 |
| Two Pair | 2 for 1 |
| Pair of Jacks or better | 1 for 1 |

Figure 3:
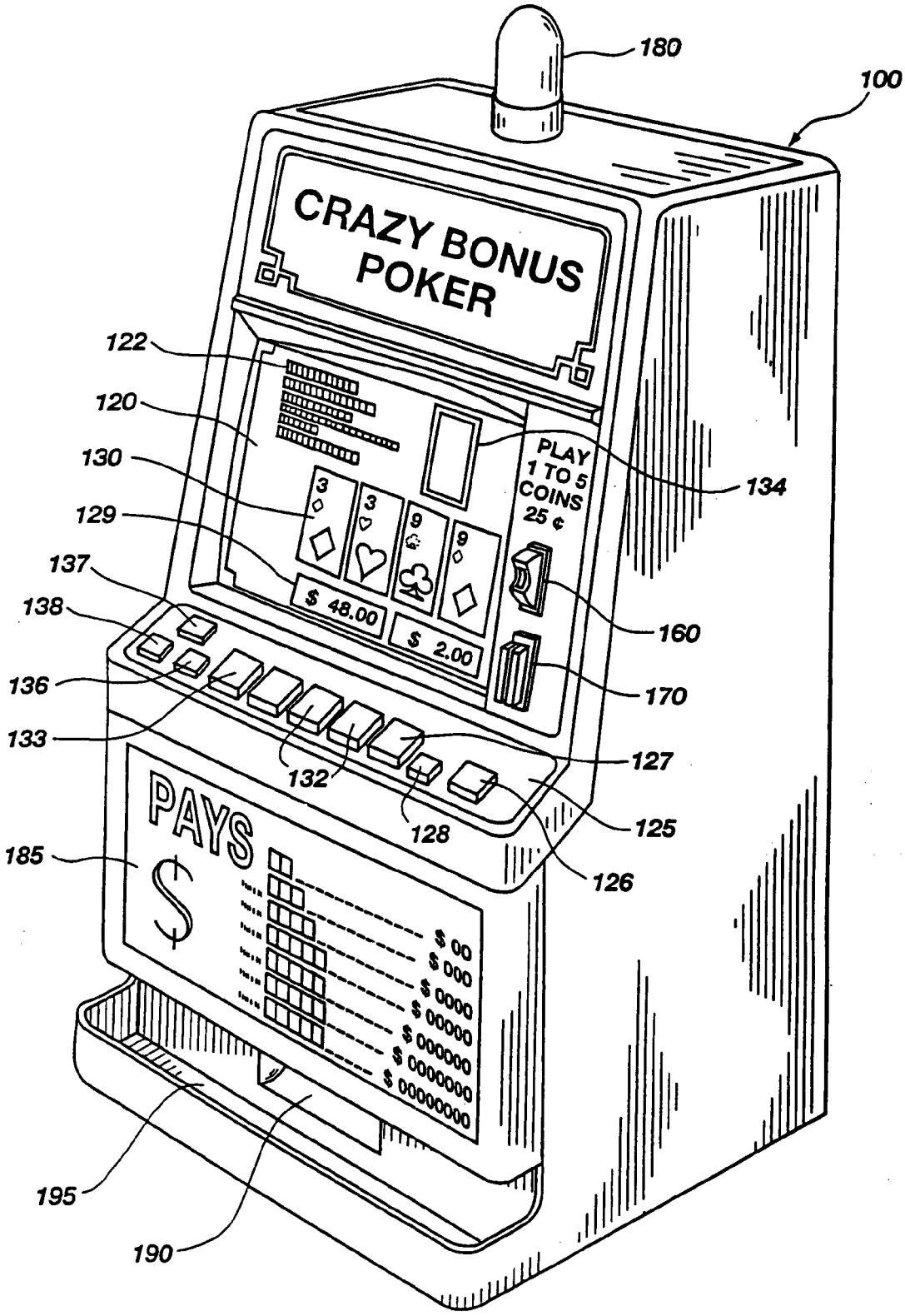
FIG. 3 illustrates a gaming device of another embodiment of the present invention.

An alternative embodiment of the present invention is illustrated in FIG. 3 in the form of a gaming device. This embodiment of the present invention differs from the embodiment illustrated in FIGS. 1 and 2 in that decisions are input to the machine by the player depressing one or more buttons on a button panel 125. Button panel 125 comprises a "DEAL/DRAW" button 126, "BET ONE" button 128, a "BET MAX" button 127, a plurality of "HOLD" buttons 132, a "RESERVE WILD CARD" button 133, a "CASH/CREDIT" button 136, a change button 137 and a "COLLECT WINNINGS" button 138. According to this embodiment of the present invention, after a player has input monetary value into coin slot 160 or bill validator 170, he can select the amount that he wants to wager on the present hand by depressing "BET ONE" button 128 the number of times needed to properly show his wager in the wager window on screen 120 or BET MAX button 127. The remaining portion of the player's credits will be indicated in credit window 129. The player then depresses "DEAL/DRAW" button 126 in order to receive a first plurality of cards. The player may then select which cards to hold by depressing corresponding "HOLD" buttons 132, which are most preferably aligned with the indicia of playing cards 130 appearing on screen 120. If the player has received a wild card that he wishes to reserve for use in a subsequent hand, the player then depresses "RESERVE" button 133, which will move the wild card up into wild card reserve area 134 on screen 120.

When the player has made his selection regarding which cards to hold and/or reserve, he must then again press "DEAL/DRAW" button 126 in order to receive replacement cards. According to this illustrated embodiment, after the player has received any necessary replacement cards, the gaming device 100 automatically evaluates whether the player has received a winning hand and, if he has, provides a winning payout according to payout schedule 185, signals the winning payout with flashing light 180 and increases the player's credits shown in credit window 129 accordingly. When a player has finished playing and wishes to withdraw any credits shown in credit window 129, the player can simply depress "COLLECT WINNINGS" button 138 in order to receive his money from coin chute 190 and coin trough 195 and/or credits. As illustrated, button panel 125 is also provided with "CHANGE" button 137 which will alert a casino attendant that a player requires change.

Figure 4:
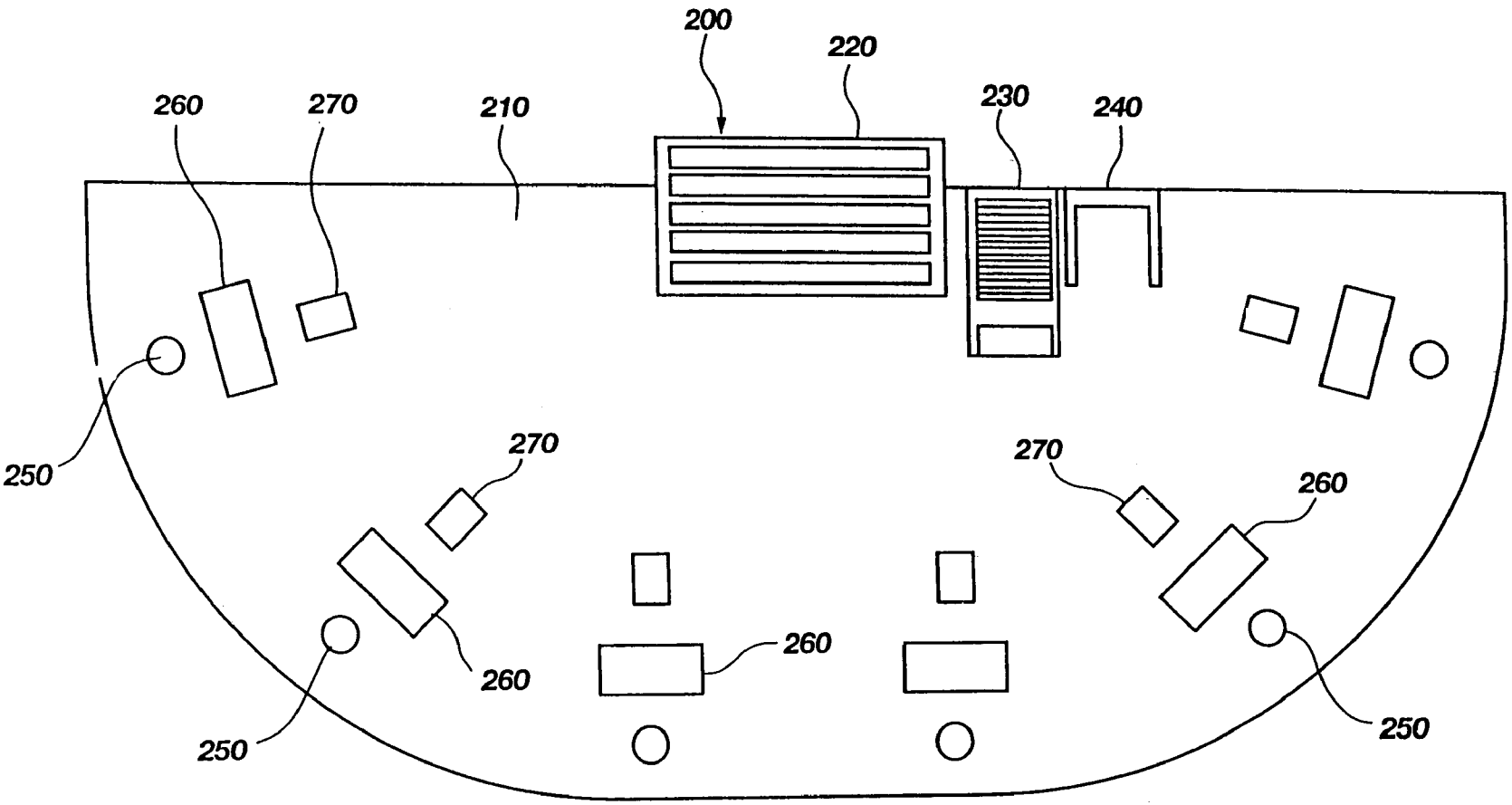
FIG. 4 illustrates a board game embodiment of the present invention.

Another embodiment of the present invention is illustrated in FIG. 4 wherein a gaming table 200 is provided with a playing surface 210, chip rack 220, card shoe 230 and discard tray 240. A plurality of player stations is located around the playing surface. According to this embodiment of the present invention, each playing area comprises a wager area 250, a card area 260 and a wild card reserve area 270. According to this embodiment of the present invention, when a player wishes to reserve a wild card for subsequent use, the reserved wild card is placed in a "wild card reserve area" 270.

While the present embodiments have been described as providing a player with an option of reserving a wild card when that player receives such a wild card during the initial deal, the various embodiments of the present invention can also provide a player with the option of reserving a wild card for use in a subsequent hand even if that player receives one or more wild cards as replacement cards for those which he had originally discarded or reserved. Furthermore, a player may be provided with the option of retrieving a wild indicia from a wild indicia reserve area for use in the same game that the wild indicia was received, either between or after the player has received or seen additional playing indicia.

As a further enhancement to the excitement provided by the games of the present invention, it is also within the scope of the present invention to provide a higher or lower payout when the player uses a wild indicia.

The present invention is readily adapted for use with a wide variety of wagering games of chance or skill including blackjack, other forms of poker, keno, bingo, lotto, as well as with video slots and/or a reel slot. For example, other card games such as blackjack may be similarly played wherein one or more wild card indicia are displayed to players either in a physical form, such as in a table version, or as an image on a screen in a video version.

Those skilled in the art will appreciate that the present invention can be modified for use in other games with or without additional restrictions. For example, in a bingo game, a wild indicia received during one game may be utilized in subsequent games to cover whatever spot that a player chooses. In a lotto game, a player might utilize a wild indicia for use as any number in a subsequent play. Still further embodiments may comprise placing a wild indicia on one or more faces of a die for use in a dice game. Therefore, it is within the scope of the present invention to utilize the traveling wild indicia of the present invention in games of craps. In a keno game, the keno game could be limited to permit a player to use a reserved wild indicia in subsequent plays only if the player was using an identical wager in an identically played game. The use of the wild indicia may be restricted to a predetermined number of hands following the receipt of the wild indicia by the player. These and other restrictions may or may not be imposed on other wagering games of chance or skill.

According to further embodiments of the present invention, a wild indicia may have limitations. For example, the wild indicia may be completely wild in that it can be used as a substitute to any indicia in the game. Alternatively, the wild indicia may be restricted so that it can only be played as certain other symbols.

Furthermore, according to a further embodiment of the present invention, the mere reciept of a wild indicia can provide a player with one or more winning advantages. For example, a wild indicia may act as a multiplier in order to modify the payout schedule. Alternatively, the receipt of a wild indicia may provide or qualify the player for a super-jackpot. Still futhermore, a player may be provided with an opportunity to increase the amount of a payout by some percentage, e.g., 25% or even by a multiplier of two or three. Still furthermore, the wild indicia could also provide opportunities for a player to qualify for other opportunities. For example, in a card game if a wild card was utilized to form a royal flush, that winning player could be entered into a super-jackpot prize drawing. Those skilled in the art will appreciate that these embodiments may be achieved without departing from the scope of the present invention.

What is claimed is:

1. A gaming device comprising:

a display screen that is capable of generating video images;

the gaming device being programmed to:

select a first group of indicia from a plurality of indicia in a first game, the plurality of indicia including a plurality of playing indicia and at least one wild indicia;

cause a video image representing the first game to be displayed on the display screen;

provide a player with a winning advantage if the player receives the at least one wild indicia, wherein the winning advantage is at least one of allowing the wild indicia to act as a multiplier in order to modify a payout schedule, qualifying the player for a super-jackpot, providing the player with an opportunity to increase the amount of a payout, or providing opportunities for the player to qualify for another opportunity; and limit in which one or more subsequent games the player may use the at least one wild indicia.

2. The gaming device as defined in claim 1, wherein the gaming device is further programmed to decrease a payout to the player when the player uses at least one wild indicia.

3. The gaming device as defined in claim 1, wherein the gaming device is further programmed to display the first group of indicia to the player.

4. The gaming device as defined in claim 1, wherein the gaming device is further programmed to select a subsequent group of indicia from the plurality of indicia to define one of one or more subsequent games.

5. The gaming device as defined in claim 1, wherein the gaming device is further programmed to:

determine a game outcome according to a group of playing indicia and at least one wild indicia; and determine a game payout according to the game outcome.

6. The gaming device as defined in claim 1, further comprising a value input device and a plurality of selection devices;

the gaming device being further programmed to:

determine that the player has used the value input device to make a wager;

determine that the player has used one of the plurality of selection devices to reserve the at least one wild indicia for use in a subsequent game;

determine a first game outcome associated with the first group of playing indicia;

determine a first payout associated with the first game outcome;

determine a game outcome associated with a subsequent group of playing indicia and the at least one wild indicia; and determine a subsequent payout associated with the game outcome associated with the subsequent group of playing indicia and the at least one wild indicia.

7. The gaming device as defined in claim 1, wherein the at least one wild indicia is not one of the plurality of playing indicia.

8. The gaming device as defined in claim 1, wherein the winning advantage includes the ability to reserve the at least one wild indicia in the first game for use in one of one or more subsequent games.

9. The gaming device as defined in claim 8, wherein the gaming device is further programmed to limit in which one of the one or more subsequent games the player may use the at least one wild indicia.

10. The gaming device as defined in claim 8, wherein the first and subsequent games are one of the following games: poker, blackjack, keno, reel slots, video slots, dice, bingo, and lotto.

11. The gaming device as defined in claim 8, wherein the video image represents one of the following games: video poker, video blackjack, video slots, video keno, video bingo, video dice, or video lotto;

the video image comprising an image of at least five playing cards if the game comprises video poker, the video image comprising an image of a plurality of simulated slot gaming device reels if the game comprises video slots, the video image comprising an image of a plurality of playing cards if the game comprises video blackjack, the video image comprising an image of a plurality of keno numbers if the game comprises video keno, the video image comprising an image of a bingo grid if the game comprises video bingo, the video image comprising an image of at least one die if the game comprises video dice, and the video image comprising an image of a plurality of numbers if the game comprises video lotto.

12. The gaming device as defined in claim 8, wherein the gaming device is further programmed to qualify the player for a bonus game when the player uses the reserved at least one wild indicia.

13. The gaming device as defined in claim 8, wherein the gaming device is further programmed to qualify the player for a super-jackpot when the player uses the reserved at least one wild indicia.

14. The gaming device as defined in claim 8, wherein the gaming device is further programmed to select the first group of indicia and the subsequent group of indicia randomly.

15. The gaming device as defined in claim 8, wherein the first game and the subsequent games are card games, the plurality of indicia are a plurality of cards, the first group of indicia is a first group of cards, and the at least one wild indicia is at least one wild card.

16. The gaming device as defined in claim 15, wherein the gaming device is further programmed to provide the player with a draw card that is selected from the plurality of cards to replace one of the plurality of playing cards in the first group of cards.

17. The gaming device as defined in claim 15, wherein the gaming device is further programmed to provide the player with at least one replacement card that is selected from the plurality of cards to replace one of the plurality of cards in the first group of cards when the player reserves the at least one wild card for use in the one of one or more subsequent card games.

18. The gaming device as defined in claim 17, wherein the gaming device is further programmed to prohibit the player from reserving the at least one wild card if the player received the at least one wild card as a draw card.

19. The gaming device as defined in claim 9, wherein the gaming device is further programmed to provide the player with the option of using the reserved at least one wild indicia in one of a predetermined number of subsequent games.

20. A gaming device comprising:

a display screen that is capable of generating video images;

a selection device;

a monetary value input device;

the gaming device being programmed to:

determine that a player has used the monetary value input device to make a wager;

provide a first group of playing indicia to define a first game, the first group of playing indicia being selected from a plurality of playing indicia;

provide at least one wild indicia for use in other than the first game;

cause a video image representing the first game to be displayed on the display screen;

determine that the player has used the selection device to reserve the at least one wild indicia for use in a subsequent game;

determine a first game outcome associated with the first group of playing indicia;

determine a first payout according to a payout schedule, the first payout being associated with the first game outcome;

provide a subsequent group of playing indicia to define the subsequent game, the subsequent group of playing indicia being selected from the plurality of playing indicia;

determine that the player has used the selection device to combine the at least one wild indicia with the subsequent group of playing indicia to define a modified group of playing indicia;

determine a game outcome associated with the modified group of playing indicia; and determine a subsequent payout associated with the game outcome associated with the modified group of playing indicia by modifying the payout for the game outcome associated with the modified group of playing indicia.

21. The gaming device as defined in claim 20, wherein modifying the payout for the game outcome associated with the modified group of playing indicia comprises decreasing the payout for the game outcome associated with the modified group of playing indicia in comparison to a payout when the wild indicia is not used.

22. The gaming device as defined in claim 20, wherein the gaming device is further programmed to limit the use of the wild indicia in the subsequent game.

23. The gaming device as defined in claim 20, wherein the first and subsequent games are one of the following games: poker, blackjack, keno, reel slots, video slots, dice, bingo, and lotto.

24. The gaming device as defined in claim 20, wherein the video image represents one of the following games: video poker, video blackjack, video slots, video keno, video bingo, video dice, or video lotto;

the video image comprising an image of at least five playing cards if the game comprises video poker, the video image comprising an image of a plurality of simulated slot gaming device reels if the game comprises video slots, the video image comprising an image of a plurality of playing cards if the game comprises video blackjack, the video image comprising an image of a plurality of keno numbers if the game comprises video keno, the video image comprising an image of a bingo grid if the game comprises video bingo, the video image comprising an image of at least one die if the game comprises video dice, and the video image comprising an image of a plurality of numbers if the game comprises video lotto.

25. The gaming device as defined in claim 20, wherein the gaming device is further programmed to qualify the player for a bonus game when the player uses the reserved at least one wild indicia.

26. The gaming device as defined in claim 20, wherein the gaming device is further programmed to qualify the player for a super-jackpot when the player uses the reserved at least one wild indicia.

27. The gaming device as defined in claim 20, wherein the gaming device is further programmed to select the first group of playing indicia and the subsequent group of playing indicia randomly.

28. The gaming device as defined in claim 20, wherein the first game and the subsequent games are card games, the plurality of playing indicia are a plurality of cards, the first group of playing indicia is a first group of cards, and the at least one wild indicia is at least one wild card.

29. The gaming device as defined in claim 28, wherein the gaming device is further programmed to provide the player with a draw card that is selected from the plurality of cards to replace one of the plurality of cards in the first group of cards.

30. The gaming device as defined in claim 28, wherein the gaming device is further programmed to provide the player with at least one replacement card that is selected from the plurality of cards to replace one of the plurality of cards in the first group of cards when the player reserves the at least one wild card for use in the subsequent card game.

31. The gaming device as defined in claim 30, wherein the gaming device is further programmed to prohibit the player from reserving the at least one wild card if the player received the at least one wild card as a draw card.

32. The gaming device as defined in claim 20, wherein the at least one wild indicia is not one of the plurality of playing indicia.

33. A gaming device, comprising:

a display screen that is capable of generating video images;

the gaming device being programmed to:

select a first group of indicia from a plurality of indicia in a first game, the plurality of indicia including a plurality of playing indicia and a wild indicia, wherein the wild indicia is not one of the plurality of playing indicia;

cause a video image representing the first game to be displayed on the display screen; and provide a player with the option of reserving the wild indicia in the first game for use in a subsequent game.

34. The gaming device as defined in claim 33, further comprising a monetary value input device and a selection device, wherein the gaming device is programmed to:

determine that a player has used the monetary value input device to make a wager;

determine that the player has used the selection device to reserve the at least one wild indicia for use in the subsequent game;

determine a game outcome associated with the first set of playing indicia;

determine a game payout associated with the first game outcome;

determine a subsequent game outcome associated with a subsequent set of playing indicia and the at least one wild indicia; and determine a subsequent game payout associated with the subsequent game outcome.

35. The gaming device as defined in claim 34, wherein the gaming device is programmed to modify the subsequent game payout when the at least one wild indicia is used.

36. The gaming device as defined in claim 34, wherein the first game and the subsequent games are card games, the plurality of indicia are a plurality of cards, the first group of indicia is a first group of cards, and the at least one wild indicia is at least one wild card.

37. The gaming device as defined in claim 35, wherein the gaming device is programmed to decrease the subsequent payout in comparison to a game payout that is determined when the at least one wild indicia is not used.

38. The gaming device as defined in claim 36, wherein the gaming device is further programmed to provide the player with a draw card that is selected from the plurality of cards to replace one of the plurality of playing cards in the first group of cards.

39. The gaming device as defined in claim 36, wherein the gaming device is further programmed to provide the player with at least one replacement card that is selected from the plurality of cards to replace one of the plurality of cards in the first group of cards when the player reserves the at least one wild card for use in the one of one or more subsequent card games.

40. The gaming device as defined in claim 33, wherein the gaming device is programmed to limit the use of the wild indicia in the subsequent game.

41. The gaming device as defined in claim 40, wherein the gaming device is programmed to provide the player with the option of using the reserved at least one wild indicia in one of a predetermined number of subsequent games.

42. The gaming device as defined in claim 33, the game being one of the following games: poker, blackjack, keno, reel slots, video slots, dice, bingo and lotto.

43. The gaming device as defined in claim 33, wherein the video image represents one of the following games: video poker, video blackjack, video slots, video keno, video bingo, video dice, or video lotto;

the video image comprising an image of at least five playing cards if the game comprises video poker, the video image comprising an image of a plurality of simulated slot gaming device reels if the game comprises video slots, the video image comprising an image of a plurality of playing cards if the game comprises video blackjack, the video image comprising an image of a plurality of keno numbers if the game comprises video keno, the video image comprising an image of a bingo grid if the game comprises video bingo, the video image comprising an image of at least one dice if the game comprises video dice, and the video image comprising an image of a plurality of numbers if the game comprises video lotto.

44. The gaming device as defined in claim 33, wherein the gaming device is programmed to qualifying the player for a bonus game when the player uses the wild indicia.

* * * * *